US008194015B1

(12) United States Patent
Orlando et al.

(10) Patent No.: US 8,194,015 B1
(45) Date of Patent: Jun. 5, 2012

(54) REDUCTION OF THE EFFECT OF AVDD POWER SUPPLY VARIATION ON GAMMA REFERENCE VOLTAGES AND THE ABILITY TO COMPENSATE FOR MANUFACTURING VARIATIONS

(75) Inventors: Richard V. Orlando, Los Gatos, CA (US); Trevor A. Blyth, Sandy, UT (US)

(73) Assignee: Alta Analog, Inc., San Jose, CA (US)

( * ) Notice: Subject to any disclaimer, the term of this patent is extended or adjusted under 35 U.S.C. 154(b) by 934 days.

(21) Appl. No.: 11/711,203

(22) Filed: Feb. 26, 2007

(51) Int. Cl.
*G09G 3/36* (2006.01)

(52) U.S. Cl. ..... 345/87

(58) Field of Classification Search ..... 345/87, 345/211–214
See application file for complete search history.

(56) References Cited

U.S. PATENT DOCUMENTS 6,195,289 B1 * 2/2001 Pasotti et al. ..... 365/185.21
2001/0040825 A1 * 11/2001 Sugimura ..... 365/185.22
2002/0180680 A1 * 12/2002 Moon ..... 345/89
2003/0162317 A1 * 8/2003 Tanaka et al. ..... 438/48
2003/0169066 A1 * 9/2003 Uh et al. ..... 324/770
2005/0018113 A1 * 1/2005 Shen et al. ..... 349/114
2005/0243225 A1 * 11/2005 Janssen et al. ..... 349/18
2006/0132682 A1 * 6/2006 Yang et al. ..... 349/114
2006/0290831 A1 * 12/2006 You ..... 349/56
2006/0290848 A1 * 12/2006 Choi et al. ..... 349/114
2009/0137213 A1 * 5/2009 Rofougaran et al. ..... 455/77

* cited by examiner

*Primary Examiner* — Amr Awad
*Assistant Examiner* — Dennis Joseph
(74) *Attorney, Agent, or Firm* — Fernandez & Associates, LLP

(57) ABSTRACT

The invention relates to an apparatus for electronic display comprising means for generating liquid-crystal-display (LCD) input signals, a LCD panel operable to display a color image according to the LCD input signals, a circuit operable to generate a plurality of sets of gamma correction values for gamma correction of the LCD input signals, and means for eliminating dependency of the plurality of sets of gamma correction values on a supply voltage (AVDD) of the circuit.

1 Claim, 8 Drawing Sheets

200

REDUCTION OF THE EFFECT OF AVDD POWER SUPPLY VARIATION ON GAMMA REFERENCE VOLTAGES AND THE ABILITY TO COMPENSATE FOR MANUFACTURING VARIATIONS

CROSS-REFERENCE TO RELATED APPLICATIONS

This application relates to U.S. application Ser. No. 10/746,333 entitled "Gamma reference Voltage Generator" filed on Dec. 23, 2003, which is incorporated herein by reference.

BACKGROUND INFORMATION

1. Field of the Invention

The invention related generally to the field of electronic displays and more particularly to Color Liquid Crystal Displays (LCDs).

2. Description of Related Art

The LCD industry is facing a major challenge in trying to reduce the acknowledged variation in color performance from panel to panel within the same manufacturer as well as between manufacturers of the same panel. The reduction in the panel to panel variation has long been desired from manufacturers, integrators, software developers and even end users. For example, Microsoft recently issued a specification for color consistency outlined in the Windows Color Quality Specifications for Liquid Crystal Display OEMs (hereinafter referred to as Windows VISTA specification) in which Delta E measurement criteria is specified based on the IEC 61966-2-1 standard for sRGB. This technique selects a certain number of colors in the sRGB color space, gives their color coordinates (R,G,B) and compares the measured color's chromaticity and luminance to a reference. The color's error from the reference color is referred to as the Delta E for that color patch. Microsoft's specification requires that the panel's measured values are below an average value and a maximum value for a specified set of colors. Specifically, the display luminance level must be greater than or equal to 75 cd/m$^2$ and the Delta E is required to meet the following requirements:

(a) Average 1994 Delta E less than or equal to 20 for IEC 61966-4 (section 11 for Inter-Channel Dependency) set of 32 colors.

(b) Stand alone or desktop LCDs:

Average 1994 Delta E less than or equal to 10 for desktop set of common colors.

Maximum 1994 Delta E less than or equal to 15 for desktop set of common set of colors.

(c) Integrated or notebook LCDs:

Average 1994 Delta E less than or equal to 10 for notebook set of common set of colors.

Maximum 1994 Delta E less than or equal to 15 for notebook set of common set of colors.

The Delta E calculation is weighted more heavily on changes in luminance from the reference than chromaticity, which increases the effect of changing gamma on Delta E values. The Delta E criteria of the Windows VISTA specification are much more significant than other attempts to specify the color performance of the panel, since it actually compares the measured color to a specified standard. It should be noted that the more traditional specification of gamma 2.2+/10% will result in failures in meeting the Delta E specification of the above referenced specification. It can be shown that using the current manufacturing processes and for the expected variation in gamma from panel to panel, it will be next to impossible to guarantee that all panels meet the Microsoft Delta E specification.

It can be assumed that once the panel manufacturers begin delivering to this specification for the notebook and monitor markets, that the television manufacturers will also demand the same level of consistency. The problem for the panel manufacturers is that guaranteeing some level of color performance will require additional testing and processing in the panel assembly lines, which could negatively impact cycle time, costs and yields. The primary causes of panel to panel color variation are: Gamma variation, color filter consistency and backlight color temperature. It is desirable to eliminate or compensate for the gamma variation, and hence eliminate the largest cause for panel to panel color variation.

SUMMARY OF THE INVENTION

In general, in one aspect, the present invention relates to an apparatus for electronic display comprising means for generating liquid-crystal-display (LCD) input signals, a LCD panel operable to display a color image according to the LCD input signals, a circuit operable to generate a plurality of sets of gamma correction values for gamma correction of the LCD input signals, and means for eliminating dependency of the plurality of sets of gamma correction values on a supply voltage (AVDD) of the circuit.

In general, in one aspect, the present invention relates to an integrated circuit of a liquid-crystal-display (LCD) panel-based electronic display apparatus, comprising a plurality of analog storage cells for generating a plurality of sets of gamma correction values for gamma correction of LCD input signals, and at least one analog reference cell for forming pseudo-differential circuitry with the plurality of analog storage cells to eliminate dependency of the plurality of sets of gamma correction values on a supply voltage (AVDD) of the integrated circuit, wherein the LCD panel is operable to display a color image according to the LCD input signals.

In general, in one aspect, the present invention relates to a method of gamma correction for liquid-crystal-display (LCD) panels, comprising providing a supply voltage (AVDD) independent gamma generation circuit, generating a first set of gamma correction values using the AVDD independent gamma generation circuit, and performing gamma correction for the first LCD panel using the first set of gamma correction values.

In general, in one aspect, the present invention relates to a method of gamma correction for liquid-crystal-display (LCD) panels, comprising measuring cell gaps of a plurality of mother glass panels, measuring gamma curves of a plurality of LCD panels produced from the plurality of mother glass panels, establishing a cell gap to gamma curve correlation by correlating the cell gaps to the gamma curves statistically, providing a plurality of sets of gamma correction values based on the cell gap to gamma curve correlation, selecting a first set of gamma correction values from the plurality of sets of gamma correction values based on a first cell gap of a first mother glass panel, wherein the first LCD panel is produced from the first mother glass panel, and performing gamma correction for the first LCD panel using the first set of gamma correction values.

Other aspects and advantages of the invention will become apparent from the following description and the attached claims.

BRIEF DESCRIPTION OF DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the present invention may admit to other equally effective embodiments.

DETAILED DESCRIPTION OF THE INVENTION

The relationship between gamma and color is not obvious or intuitive in the prior art. The typical transfer function by convention follows a power relationship between screen luminance and the RGB digital codes. The rule is $$Lum(R) = p_r\left(\frac{R}{255}\right)^{\gamma} + \Delta, \quad [1]$$

where Lum(R) is the screen luminance of the R primary (i.e., primary color red), $p_r$ is a units constant that relates the relative units of R primary intensity to luminance units measured in units of ftL, R/255 is the normalized digital code value for an 8 bit tone scale, γ is the power (typically 2.2 or 2.4) and Δ is a dark light or the black level of the display.

The black level is generally small compared to $$p_r\left(\frac{R}{255}\right)^{\gamma}$$

when R>>than a digital code of 50 so it can be ignored for purposes of computing the chromaticity of the device's color pallet. Chromaticity is usually specified in terms of 1931 CIE xy coordinates or 1976 CIE u'v' coordinates. Both of these are linear transformations of the three dimensional color space defined by the set of all luminance triade vectors in the form of <Lum(R), Lum(G), Lum(B)>.

Without any loss of generality one can define a chromaticity in the primary units of the display as (r', g') where $$r' = \frac{Lum(R)}{Lum(R) + Lum(G) + Lum(B)} \cong \frac{p_r\left(\frac{R}{255}\right)^{\gamma}}{p_r\left(\frac{R}{255}\right)^{\gamma} + p_g\left(\frac{G}{255}\right)^{\gamma} + p_b\left(\frac{B}{255}\right)^{\gamma}}, \text{ and} \quad [2]$$

$$g' = \frac{Lum(G)}{Lum(R) + Lum(G) + Lum(B)} \cong \frac{p_g\left(\frac{G}{255}\right)^{\gamma}}{p_r\left(\frac{R}{255}\right)^{\gamma} + p_g\left(\frac{G}{255}\right)^{\gamma} + p_b\left(\frac{B}{255}\right)^{\gamma}}. \quad [3]$$

The right hand sides of equations [2] and [3] are valid when the digital code values are large (i.e., typically greater than 50) or when the dark light is negligible.

Primary and secondary colors are defined as colors where one or two of the primaries are set to digital codes of zero and the remaining digital codes are equal. These colors are Red (R≧0, G=B=0), Green (G≧0, R=B=0), Blue (B≧0, R=G=0), Yellow (R=G≧0, B=0), Cyan (G=B≧0, R=0), Magenta (R=B≧0, G=0), and White/Gray (R=G=B≧0). The (r',g') chromaticities for Yellow, for example, can be written as $$r'(\text{Yellow}) \cong \frac{p_r}{p_r + p_g}, \text{ and} \quad [4]$$

$$g'(\text{Yellow}) \cong \frac{p_g}{p_r + p_g}, \text{ respectively.} \quad [5]$$

Equations [2] and [3] simplify to equations [4] and [5] because the constraint that the digital codes be equal or zero allows the power terms in equations [2] and [3] to cancel out. This is only exactly correct for nonzero values of at least one primary and small to negligible dark light which is typically correct for digital codes greater than 50.

Figure 1:
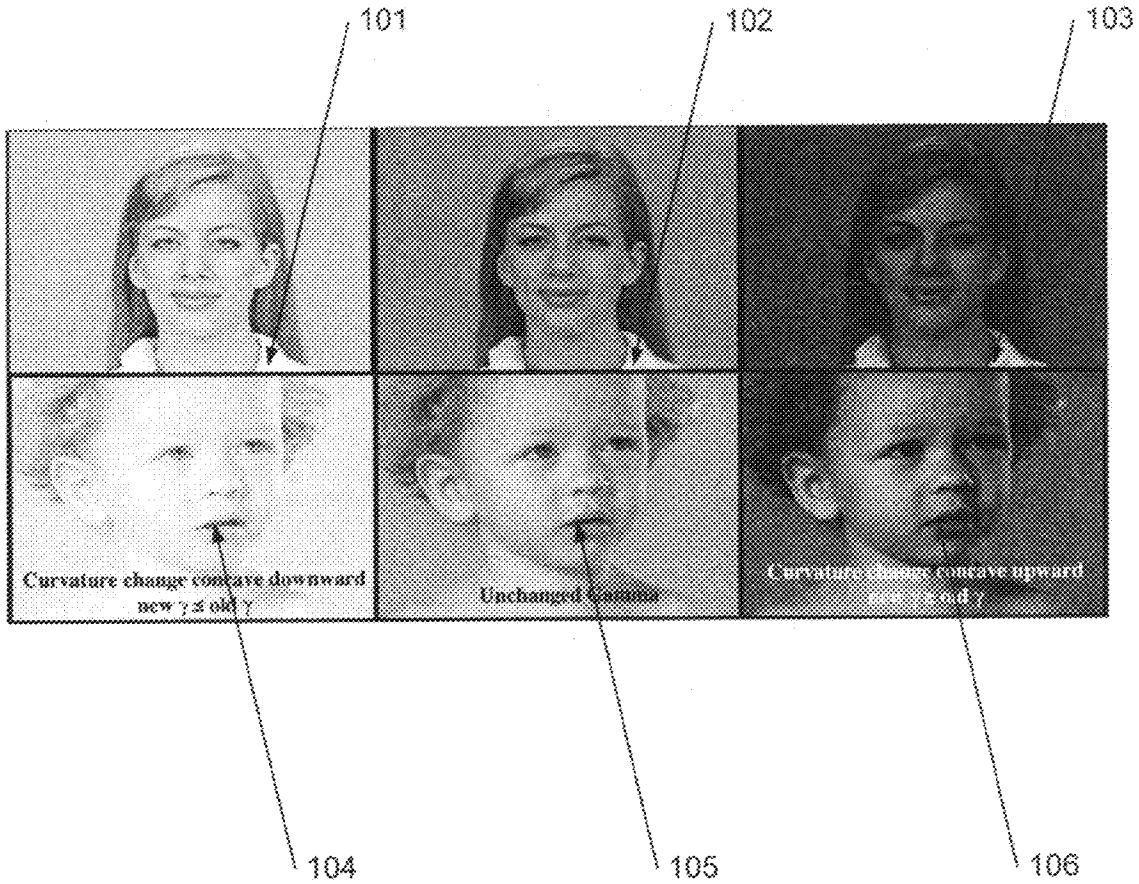
FIG. 1 shows exemplary effect of gamma variation on chromaticity in color space in accordance with aspects of the present invention.

The inspection of equations [2] and [3] given this observation reveals that all of the primary colors, Red, Green, Blue, Yellow, Cyan, Magenta, and White/Gray are independent of the power γ. It is equally evident from inspection that for any color within the color pallet of the display where R≠G≠B and at least two of these are nonzero, a color shift, or a change in chromaticity will always result from a change in the value of the power γ. Depending upon the change in the gamma value, Δγ, this will result in a saturation or de-saturation of the color relative to the prior value of γ. An example image is shown in FIG. 1. It can be seen that although gamma variation has no effect on the chromaticities of primary and secondary colors, it has great effect on the chromaticities of all other colors in the color space. FIG. 1 shows exemplary effect of gamma variation on chromaticity in color space in accordance with aspects of the present invention. The change in gamma does change the luminance of all colors with the exception of Black (0, 0, 0) and White (255, 255, 255) which can be seen at locations 101-106.

There are multiple sources for gamma variation in an LCD panel. One source of variation in the gamma of the panel is in variation in the gamma reference voltages themselves. The terms "gamma reference", "gamma value", and "gamma correction value", are used interchangeably throughout this document. Although examples using voltage to represent gamma reference are presented throughout this paper, one skilled in the art will appreciate that the "gamma reference", "gamma value", and "gamma correction value" may be represented as a voltage or a current. Traditionally, these reference voltages are generated by a resistor ladder between the panel supply (AVDD) and ground. The main concern is the variation panel to panel in these absolute voltage values, and the variation has two sources: Variation in the resistor values in the resistor ladder and variation in the AVDD value. Gamma Correction has long been a problem for the manufacturers of Thin Film Transistor (TFT) Flat Panel Displays. The Gamma Correction curve becomes more complex as the display resolution increases. Each display often has a different response to the gamma correction reference voltages, resulting in the need to generate specific gamma reference voltages for each model of display as well as compensating for display to display variation due to manufacturing process variations.

Figure 2:
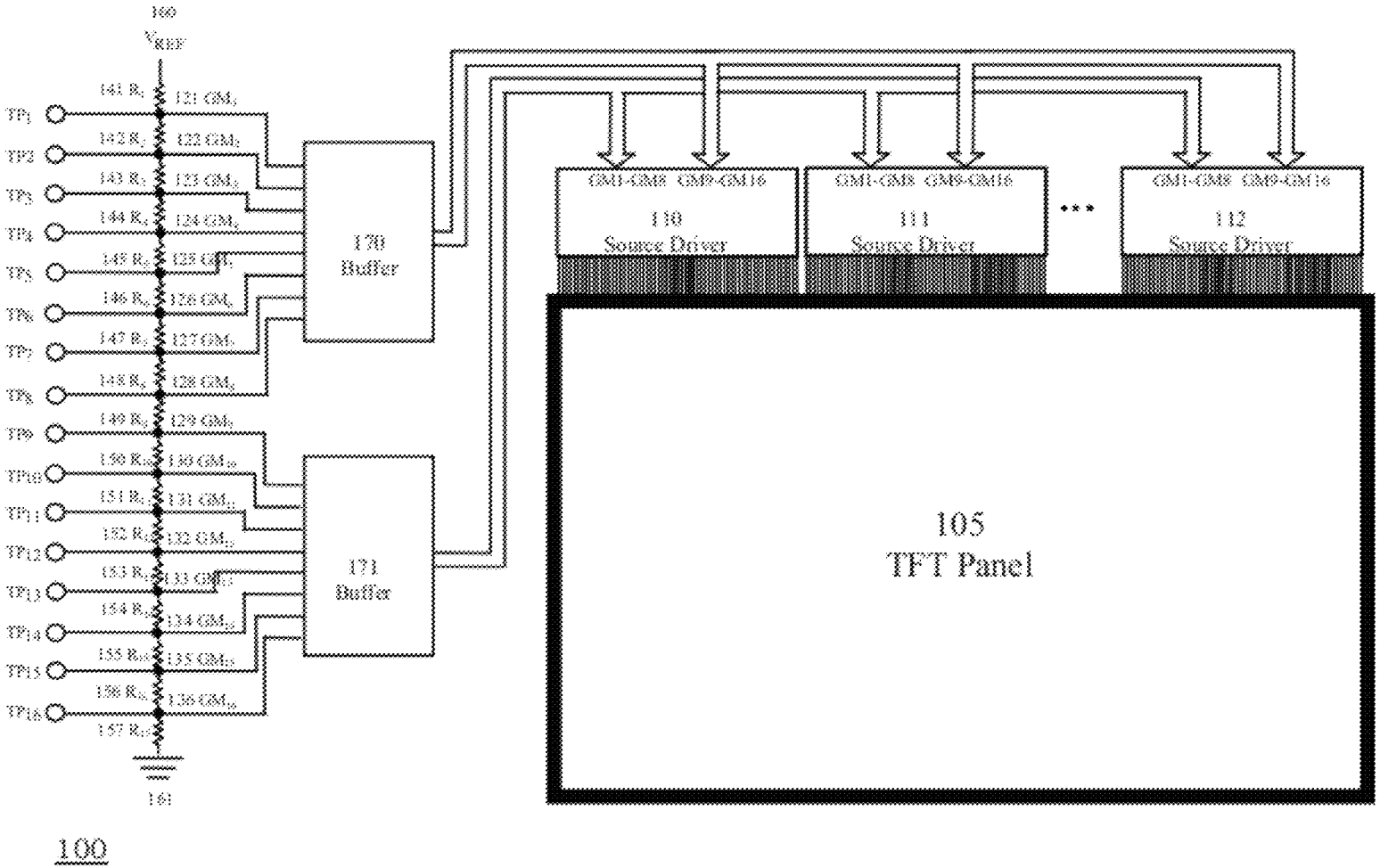
Figure 2 Prior Art
FIG. 2 shows a conventional circuit for generating gamma voltage for LCD panel.

FIG. 2 is a block diagram illustrating a conventional gamma reference circuit for a TFT display 105 using Select-On-Test-Resistors. In this case, source drivers 110, 111, . . . and 112 require a total of 16 gamma reference voltages 121 $GM_1$, 122 $GM_2$, 123 $GM_3$, 124 $GM_4$, 125 $GM_5$, 126 $GM_6$, 127 $GM_7$, 128 $GM_8$, 129 $GM_9$, 130 $GM_{10}$, 131 $GM_{11}$, 132 $GM_{12}$, 133 $GM_{13}$, 134 $GM_{14}$, 135 $GM_{15}$ and, 136 $GM_{16}$. The gamma reference voltages are derived by a resistive divider of 17 resistors 141 $R_1$, 142 $R_2$, 143 $R_3$, 144 $R_4$, 145 $R_5$, 146 $R_6$, 147 $R_7$, 148 $R_8$, 149 $R_9$, 150 $R_{10}$, 151 $R_{11}$, 152 $R_{12}$, 153 $R_{13}$, 154 $R_{14}$, 155 $R_{15}$, 156 $R_{16}$, 157 $R_{17}$ connected between a reference voltage 160 and ground 161. Since the loading of the source drivers 110, 111, and 112 changes dynamically, it is not possible to simply connect the resistive divider 141 $R_1$, 142 $R_2$, 143 $R_3$, 144 $R_4$, 145 $R_5$, 146 $R_6$, 147 $R_7$, 148 $R_8$, 149 $R_9$, 150 $R_{10}$, 151 $R_{11}$, 152 $R_{12}$, 153 $R_{13}$, 154 $R_{14}$, 155 $R_{15}$, 156 $R_{16}$, 157 $R_{17}$ to the inputs of the source drivers 110, 111, and 112, and some type of buffering are used, such gamma reference buffer ICs 170 and 171.

Initially the PC board is assembled without the resistors. An external test apparatus drives the test points TP1-TP16 until the desired Gamma correction is achieved. The values of the TP voltages are then used to calculate the resistors needed for the particular display under test (DUT) and the resistors are mounted on the PC board.

Most panel switching power supplies are accurate to +/−2.5% of the absolute value. This means that the AVDD value can vary from panel to panel +/−2.5%. The 1% resistors used in the gamma reference resistor string result in a variation of around +/−1.5%. As a result, the panel to panel variation in gamma reference voltages can be up to +/−4%.

Figure 3:
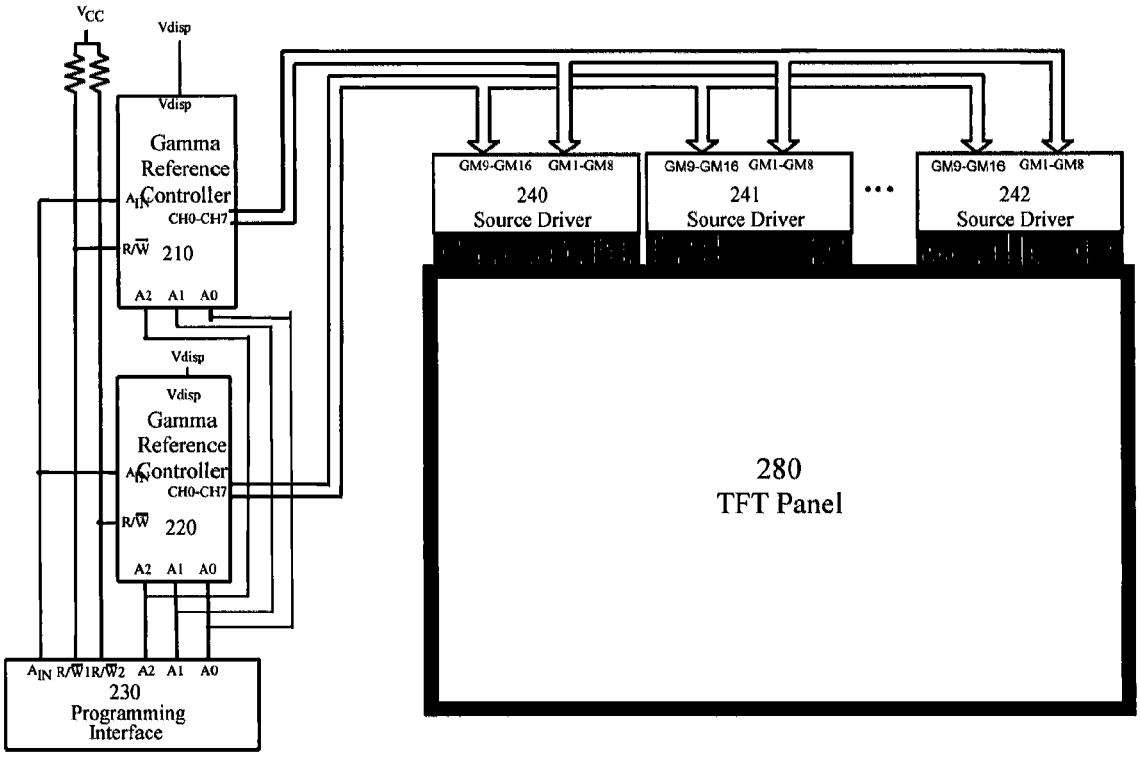
FIG. 3 shows an exemplary circuit for generating gamma voltage in accordance with aspects of the present invention.

FIG. 3 is an architectural diagram, 200, illustrating a AVDD independent gamma reference generation circuit implementation employing gamma reference controllers, 210 and 220, for a TFT panel 280. The gamma reference circuit comprises a first gamma reference controller 210, a second gamma reference controller 220, a programming interface 230, source drivers 240, 241, and 242, and a TFT panel 280. The gamma reference controller 210 drives a first set of eight gamma reference voltages GM1-GM8 to the source drivers 240, 241, . . . and 242. The gamma reference controller 220 drives a second set of eight gamma reference voltages GM9-GM 16 to the source drivers 240, 241, . . . and 242. More details of this exemplary programmable gamma reference circuit implementation and programming method can be found in U.S. application Ser. No. 10/746,333 entitled "Gamma reference Voltage Generator" filed on Dec. 23, 2003, which is incorporated herein by reference.

Figure 4:
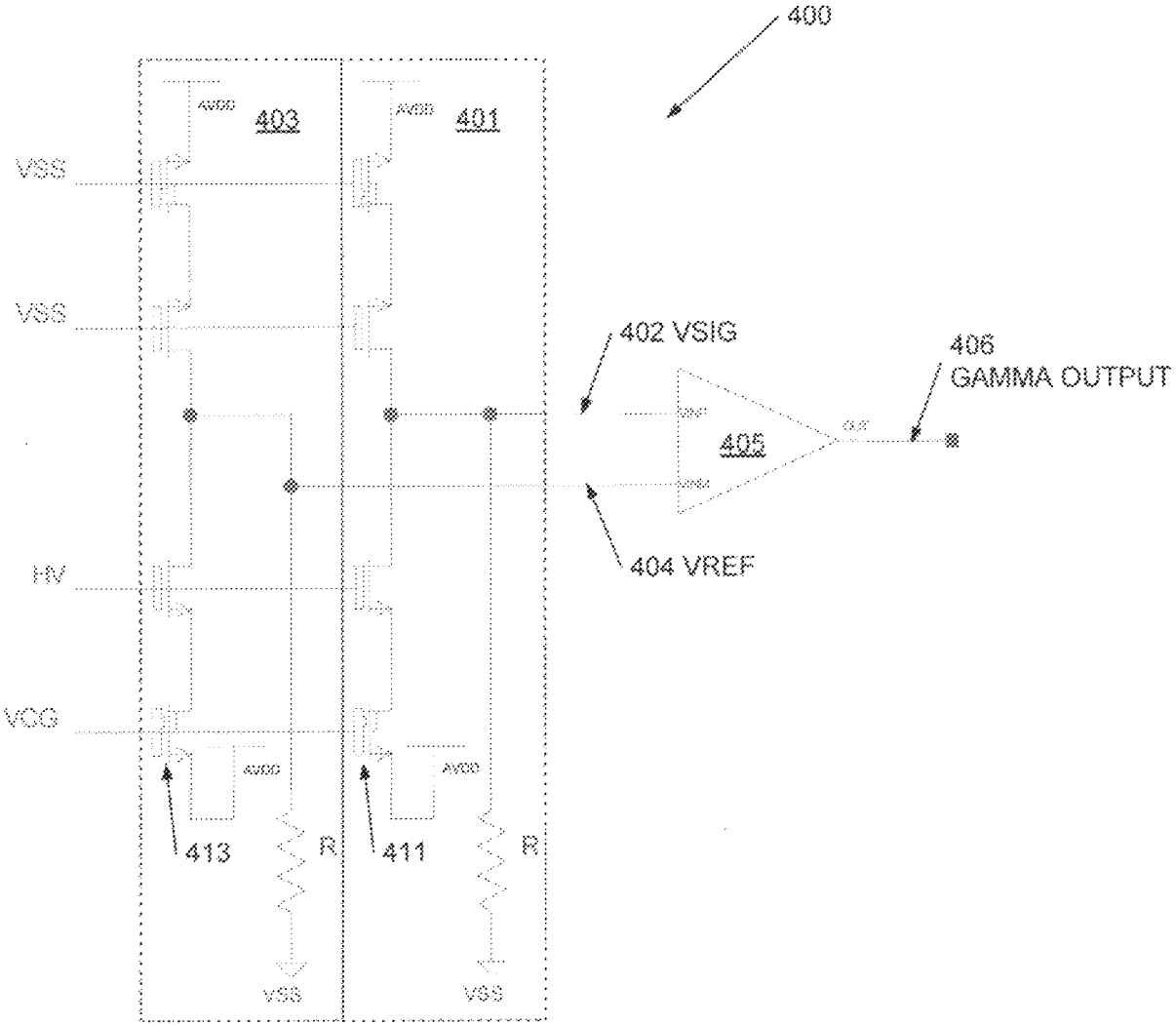
FIG. 4 shows an exemplary non-volatile analog storage cell for generating gamma voltage in accordance with aspects of the present invention.
Figure 5:
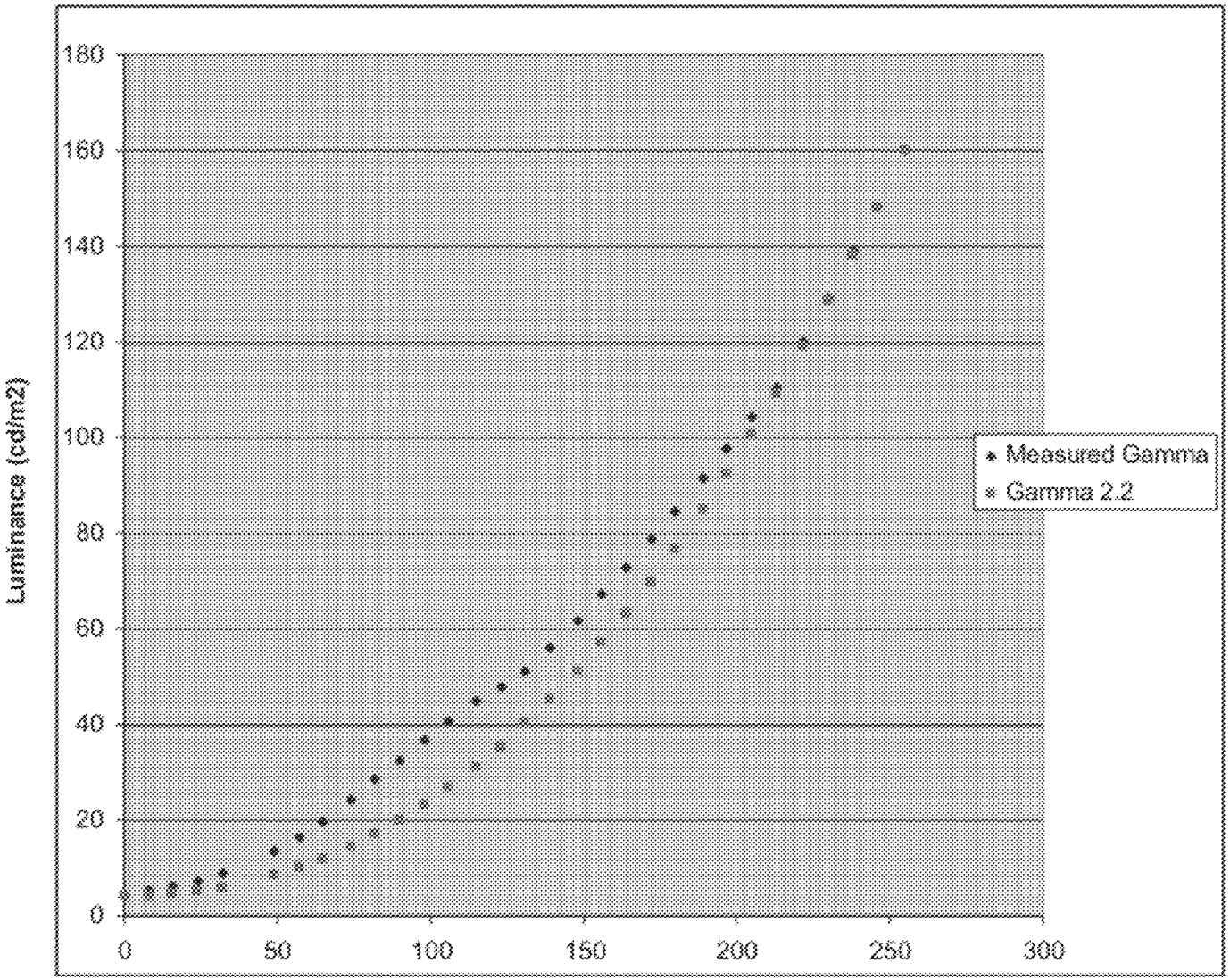
FIG. 5 shows the measured gamma curve of a LCD panel that fails the Delta E test.

The gamma reference controller 220 described above may comprise multiple programmable analog floating gate memory cells. Each programmable analog floating gate memory cell may be implemented as a pseudo-differential circuit comprising two non-volatile analog storage cells, as shown in FIG. 4, for generating gamma voltage in accordance with aspects of the present invention. Here, the pseudo-differential circuit 400 includes the non-volatile analog storage cells 401, 403, and the operational amplifier 405. The non-volatile analog storage cells 401, 403 may be implemented similar to a non-volatile digital storage cell but are enlarged for better parameter matching and noise reduction. The non-volatile analog storage cells 401, 403 may be implemented in source follower configurations to generate output voltages VSIG 402 and VREF 403 from the floating gate transistors 411 and 413 respectively. The floating gate transistor 411 may be programmed according to a pre-determined gamma value. The floating gate transistor 413 may be programmed with a reference value and may be shared with multiple programmable analog floating gate memory cells. The common mode variations of VSIG 402 and VREF 403 due to AVDD and other parameters, such as temperature, are compensated by using the differential inputs of the operational amplifier 405 to generate the gamma output 406. Therefore, the gamma output 406 represents the pre-determined gamma value independent of AVDD and other parameters, such as temperature, based on the common mode rejection capability of the pseudo-differential circuit 400. FIG. 5 of U.S. application Ser. No. 10/746,333 lists electrical parameters for the present invention. The output voltages, $V_{OLA}$ and $V_{OHA}$, of the gamma outputs CH0-CH17 have a range of 0.2V to ($V_{REFH}$−0.2V). For a VDD range of 3.3V to 5.5V the resulting change in $V_{OLA}$ and $V_{OHA}$ is reduced by a minimum of 45 dB, as specified by the PSRR (Power Supply Rejection Ratio). One skilled in the art will appreciate that the present invention may be practiced to produce the pre-determined gamma value either as gamma correction voltage or gamma correction current using either voltage mode circuitry or current mode circuitry.

FIG. 5 shows the measured gamma curve of a LCD panel that fails the Delta E test of the Windows VISTA spec. A notebook panel is measured for Delta E. Its gamma curve is set to 2.2, but as one can see from the measured gamma, it has some large errors in the middle portion of the grayscale. This panel also fails the Delta E tests both for Standalone and Integrated Panels in Gamut Colors of the Windows VISTA spec. The results are shown below:

| | | |
|---|---|---|
| Stand Alone LCDs | | |
| Results for In Gamut Colors: | | |
| CIE 1994 Delta E* | 11.4206 | FAIL |
| Maximum Delta E* | 16.47541 | FAIL |
| Results for In Gamut Colors: | | |
| CIE 1994 Delta E* | 13.90389 | PASS |
| Integrated LCDs | | |
| Results for In Gamut Colors: | | |
| CIE 1994 Delta E* | 11.92774 | FAIL |
| Maximum Delta E* | 17.47547 | FAIL |

Figure 6:
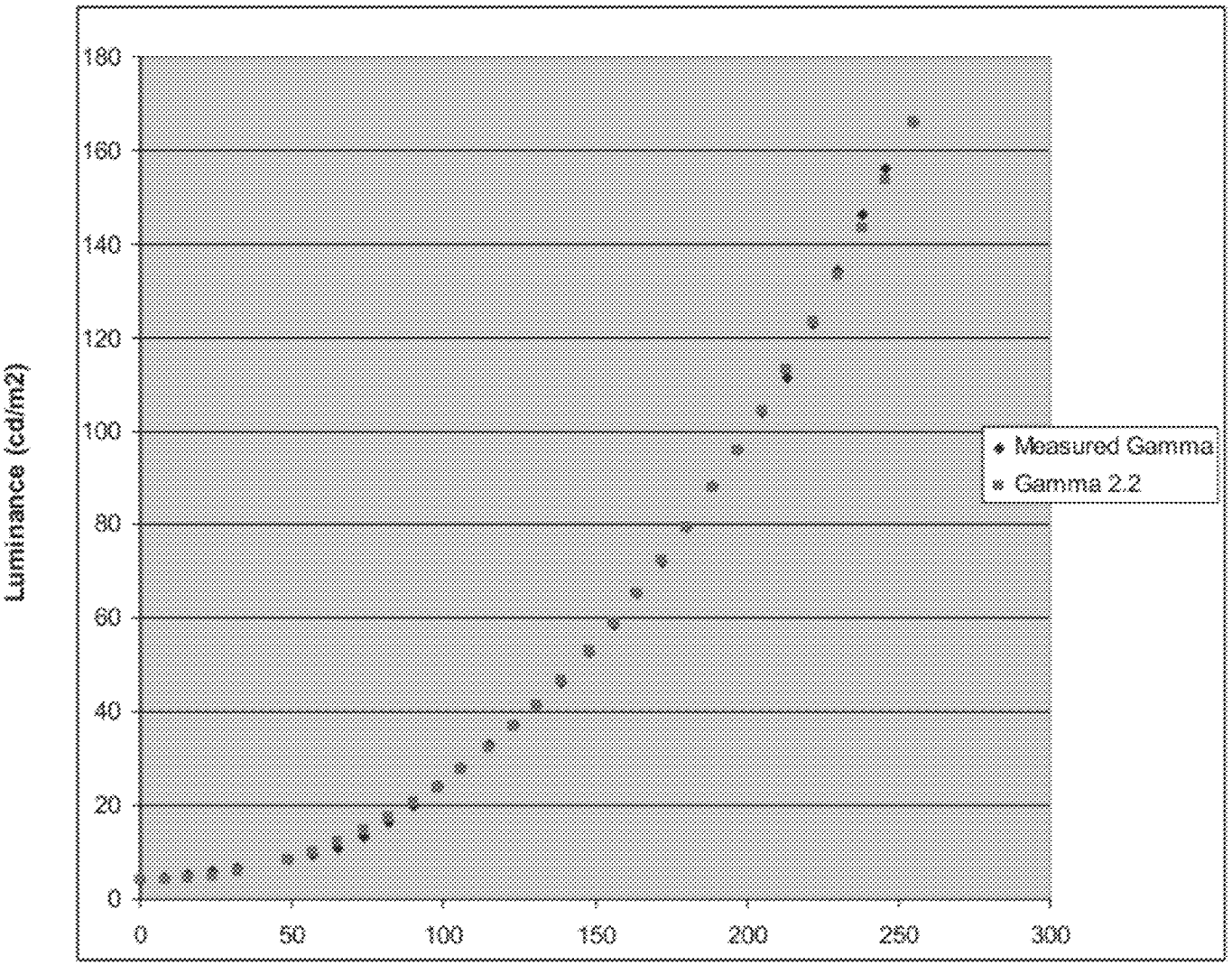
FIG. 6 shows the measured gamma curve after gamma correction and passing the Delta E test in accordance with aspects of the present invention.

FIG. 6 shows the measured gamma curve after gamma correction and passing the Delta E test of the Windows VISTA spec in accordance with aspects of the present invention. The panel, as described in FIG. 5 above, is then configured with a gamma reference circuit, such as the Alta Analog Programmable Gamma device AGN1814, and the gamma reference voltages is re-programmed to be gamma 2.2 The Gamma curve is then measured as shown in FIG. 6. The panel now easily passes the Delta E specification:

| Stand Alone LCDs | | |
|---|---|---|
| Results for In Gamut Colors: | | |
| CIE 1994 Delta E* | 8.244191 | PASS |
| Maximum Delta E* | 10.56176 | PASS |
| Results for In Gamut Colors: | | |
| CIE 1994 Delta E* | 11.80631 | PASS |
| Integrated LCDs | | |
| Results for In Gamut Colors: | | |
| CIE 1994 Delta E* | 8.868648 | PASS |
| Maximum Delta E* | 12.41362 | PASS |

Figure 7:
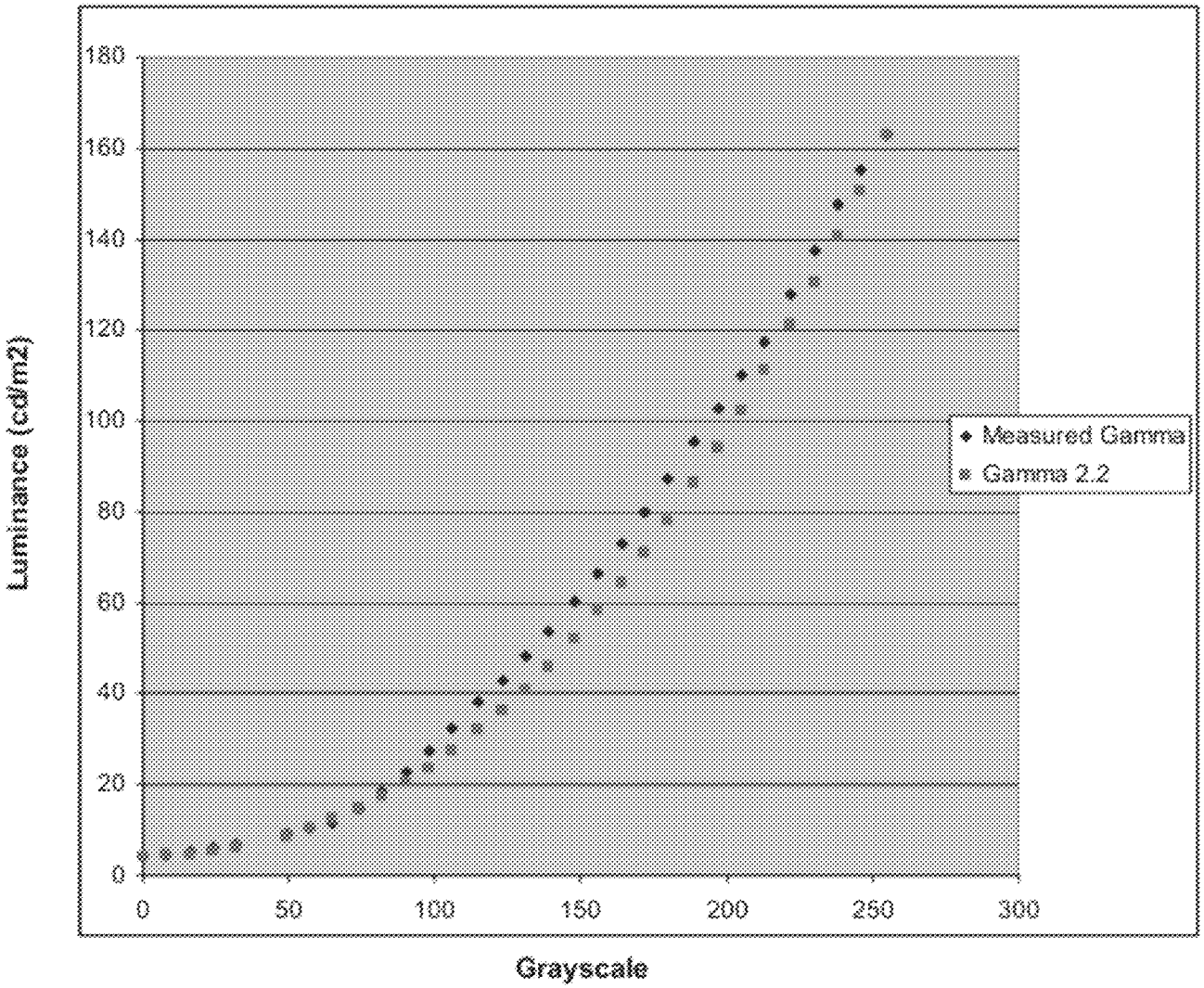
FIG. 7 shows the measured gamma curve with reduced AVDD and failing the Delta E test.

FIG. 7 shows the measured gamma curve with reduced AVDD and failing the Delta E test. In order to determine the effect of AVDD variability on the gamma curve as well as the Delta E performance, the AVDD supply was reduced by 2.5% for the panel as described in FIG. 5 above. The gamma curve is re-measured, and one can see not only a shift in the gamma curve but also a change in its curvature. The panel now fails the Delta E spec. It should be noted that a reduction in AVDD by −2.5% is only ½ of the variation one can expect from the AVDD switcher.

| Stand Alone LCDs | | |
|---|---|---|
| Results for In Gamut Colors: | | |
| CIE 1994 Delta E* | 9.110035 | PASS |
| Maximum Delta E* | 12.81176 | PASS |
| Results for In Gamut Colors: | | |
| CIE 1994 Delta E* | 12.47046 | PASS |
| Integrated LCDs | | |
| Results for In Gamut Colors: | | |
| CIE 1994 Delta E* | 10.02585 | FAIL |

Figure 8:
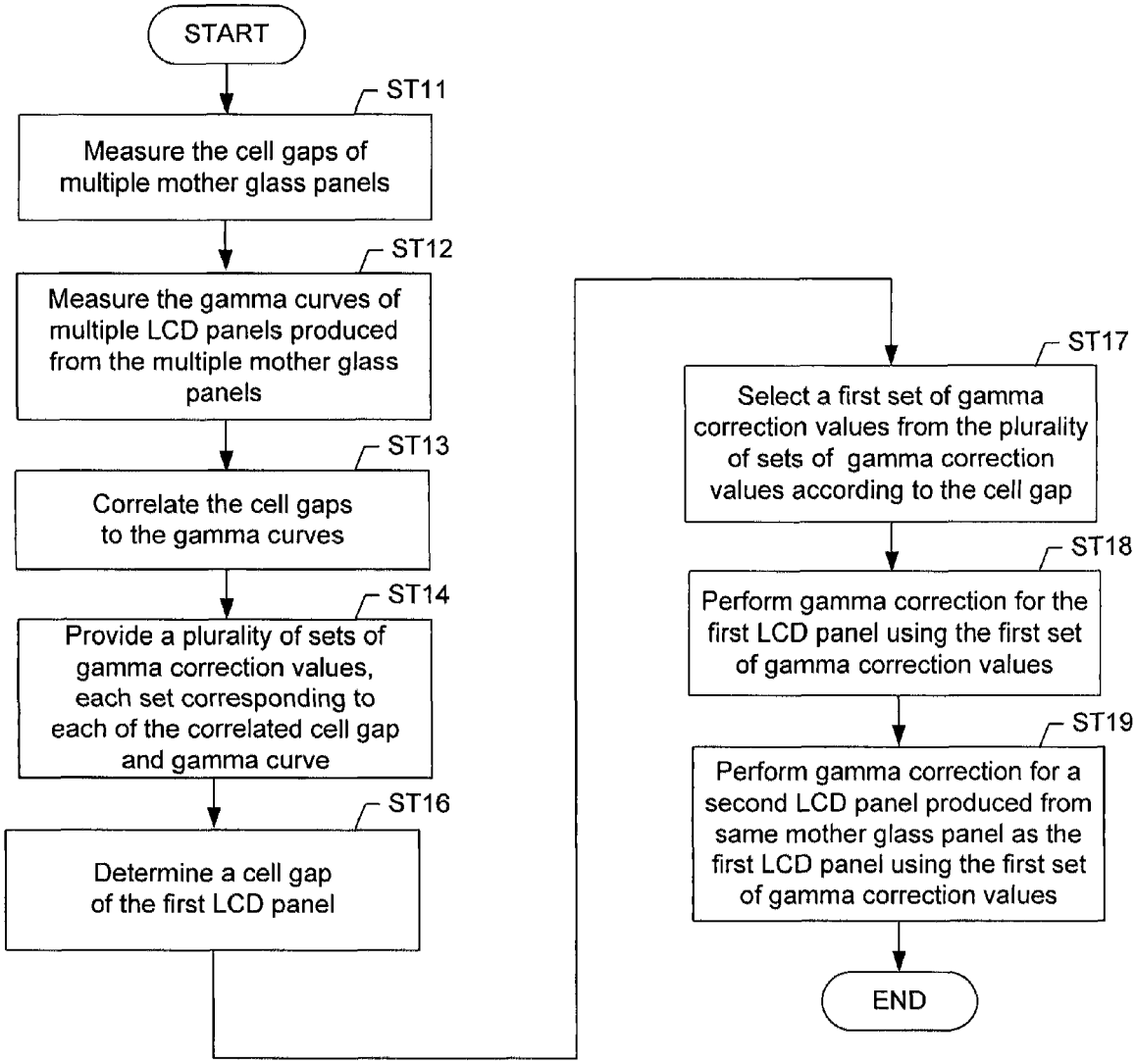
FIG. 8 shows a flow chart of a method in accordance with aspects of the present invention.

As described above, there are multiple sources for gamma variation in an LCD panel. In addition to the variation in the gamma reference voltages themselves, e.g., from variations due to AVDD dependence, another source is variations in the manufacturing process, of which the cell gap variation is by far the most significant. Cell gap is a spacing between pixels on a LCD panel. Variation of cell gap may be resulted from process variations in producing LCD panels from multiple mother glass panels. Cell gap of LCD panels produced from one mother glass panel may be consistent and is a characteristic of the mother glass panel. Cell gap of LCD panels produced from different mother glass panel may exhibit large variations. A typical level of cell gap variation achieved in manufacturing processes to produce LCD panels may be +/−10%, which results in a gamma variation of +/−10% and is too wide of a distribution to meet the Delta E requirement, e.g., of the Windows VISTA spec. This variation must be compensated for in the gamma reference voltages in order to reduce the cell gap variations effect on the final gamma of the panel. This can be accomplished by changing the gamma reference voltages to compensate for different values of cell gap. FIG. 8 shows a flow chart of a method in accordance with aspects of the present invention. Initially, cell gaps of multiple mother glass panels are measured (ST11) and gamma curves of multiple LCD panels produced from these multiple mother glass panels are also measured (ST12). Then the cell gaps and the gamma curves are correlated using well known statistical method to establish a cell gap to gamma curve correlation (ST13). Based on this cell gap to gamma curve correlation, multiple sets of gamma correction values are determined corresponding to a common range of cell gap variation from the manufacturing process in producing LCD panels from multiple mother glass panels (ST14). These multiple sets of gamma correction values may then be programmed as predetermined gamma correction values into an AVDD independent gamma reference generation circuit as described in reference to FIGS. 3 and 4 above. Continuing with the description of FIG. 8, a cell gap may be determined for a first LCD panel (ST16). A first set of gamma correction values may then be selected, based on the cell gap to gamma curve correlation from the multiple pre-determined gamma correction values in the AVDD independent gamma reference generation circuit (ST17) to perform gamma correction for the first LCD panel (ST18). In addition, a second LCD panel produced from the same mother glass panel as the first LCD may then be gamma corrected using the first set of gamma correction values (ST19).

There are many advantages of the present invention. If one assumes that the cell gap variation in the LCD panel manufacturing process is +/−10% and that the AVDD supply variation is +/−2.5% and that 1% resistors are used in the conventional gamma reference resistor string, it will be next to impossible for manufacturers to guarantee 100% compliance to the Delta E specification, e.g., of the Windows VISTA spec without some level optical testing in line.

Using an AVDD independent gamma reference generation circuit, such as Alta AGN1814 manufactured by Alta Analog, Inc., the gamma reference voltage variation may be reduced to +/−0.1%. In this case, the only variation in gamma that needs to be managed is that caused by cell gap. Since cell gap variation is a mother glass to mother glass variant, one only needs to measure the cell gap on one panel per mother glass. Up to 8 sets of gamma reference voltages can be stored in the AGN1814 to compensate for the cell gap variation, and the correct one can be selected at panel test. Testing for cell gap is much quicker than measuring the entire gamma curve for the panel. Alternatively, the gamma reference voltages of failing panels can be re-programmed at any time to optimize the settings for the panel.

As a result, the AGN1814 allows the panel manufacturer to be 100% compliant with the Microsoft Vista Delta E requirements without the need to measure and/or program the gamma in each panel. In-line monitors of cell gap can be used to determine the sample rate needed for panel measurement at any time.

While the invention has been described with respect to a limited number of embodiments, those skilled in the art, having the benefit of this disclosure, will appreciate that other embodiments can be advised or achieved which do not depart from the scope of the invention as disclosed herein. Accordingly, the scope of the invention should be limited only by the attached claims.

We claim:

1. An apparatus for electronic display comprising:

a device for generating LCD input signals;

an LCD panel operable to display a color image according to the LCD input signals;

a circuit operable to generate a plurality of sets of gamma correction values for gamma correction of the LCD input signals; and wherein the circuit further comprises one or more gamma reference controllers that are capable of reducing dependency of the plurality of sets of gamma correction values on a supply voltage (AVDD) based on common mode rejection ratio of a pseudo-differential circuit, wherein the one or more gamma reference controllers comprise:

a plurality of non-volatile analog storage cells for generating the plurality of sets of gamma correction values, and at least one non-volatile analog reference cell for forming pseudo-differential circuitry with the plurality of non-volatile analog storage cells to reduce effect of AVDD variations on gamma reference voltages, wherein output of the plurality of non-volatile analog storage cells and output of the at least one non-volatile analog reference cell are coupled to inputs of the of the pseudo differential circuit, wherein output of the pseudo differential circuit is gamma output least one non-volatile analog reference cell are coupled to inputs of the pseudo differential circuit, wherein output of the pseudo differential circuit is gamma output, wherein a portion of the pseudo-differential circuitry comprises a first non-volatile analog storage cell that comprises a first floating gate transistor and generates a first output voltage and a second non-volatile analog storage cell that comprises a second floating gate transistor and generates a second output voltage:

the first and the second floating gate transistors are programmed wherein the difference between the first output voltage and the second output voltage generates a gamma output, wherein common mode variations of the first voltage output and the second voltage output due to (1) power supply (AVDD) and (2) temperature are compensated, and wherein the gamma output represents a pre-determined gamma value that is independent of the (1) power supply (AVDD) and (2) temperature based on common mode rejection capability of the pseudo-differential circuit.

* * * * *

UNITED STATES PATENT AND TRADEMARK OFFICE

CERTIFICATE OF CORRECTION

PATENT NO. : 8,194,015 B1
APPLICATION NO. : 11/711203
DATED : June 5, 2012
INVENTOR(S) : Richard V. Orlando et al.

It is certified that error appears in the above-identified patent and that said Letters Patent is hereby corrected as shown below:

Column 9, line 11 (claim 1): delete the second "of the".

Column 9, line 13 (claim 1): delete "least one non-volatile analog reference cell are coupled to inputs of the pseudo differential circuit, wherein output of the pseudo differential circuit is gamma output".

Signed and Sealed this
Twenty-fifth Day of September, 2012

David J. Kappos

David J. Kappos
*Director of the United States Patent and Trademark Office*